United States Patent [19]

Hemsath

[11] Patent Number: 4,787,844

[45] Date of Patent: Nov. 29, 1988

[54] SEAL ARRANGEMENT FOR HIGH TEMPERATURE FURNACE APPLICATIONS

[75] Inventor: Klaus H. Hemsath, Toledo, Ohio

[73] Assignee: Gas Research Institute, Chicago, Ill.

[21] Appl. No.: 130,098

[22] Filed: Dec. 2, 1987

[51] Int. Cl.[4] ..... F27D 1/18

[52] U.S. Cl. ..... 432/242; 432/205; 432/247; 432/249; 432/250; 34/242

[58] Field of Search ..... 432/250, 249, 247, 251, 432/237, 205, 242

[56] References Cited

U.S. PATENT DOCUMENTS

| | | | |
|---|---|---|---|
| 2,791,415 | 5/1957 | Huppert | 432/205 |
| 3,019,006 | 1/1962 | Lillienberg | 263/42 |
| 3,540,710 | 11/1970 | Yamagishi et al. | 263/41 |
| 3,940,245 | 2/1976 | Smith, Jr. et al. | 432/247 |
| 3,971,875 | 7/1976 | Regalbuto | 432/205 |
| 4,212,633 | 7/1980 | Kreider et al. | 432/249 |
| 4,427,378 | 1/1984 | Bowers | 432/250 |
| 4,527,974 | 7/1985 | Carraroli et al. | 432/78 |
| 4,600,378 | 7/1986 | Fujita et al. | 432/249 |

*Primary Examiner*—Henry C. Yuen

*Attorney, Agent, or Firm*—Body, Vickers & Daniels

[57] ABSTRACT

A seal arrangement is disclosed for use in a furnace which utilizes a thin, cylindrical imperforate shell member which is heated from an external source to heat work placed within the shell. An insulated arrangement within and outside of the shell extends a spaced distance from the shell's opening to sandwich the shell's wall therebetween. The arrangement prevents heat flux by radiation and convection from heating the sandwiched wall thus permitting graded cooling of the sandwiched shell wall by conduction to a temperature whereat a conventional elastomer seal can be employed to seal the shell member.

21 Claims, 4 Drawing Sheets

SEAL ARRANGEMENT FOR HIGH TEMPERATURE FURNACE APPLICATIONS

This invention relates generally to a seal arrangement for a furnace chamber and more particularly to the use of a door seal arrangement which permits a furnace constructed in accordance with conventional practice to be operated either under vacuum or as a positive pressure vessel furnace or as a vacuum furnace.

The invention is particularly applicable to an industrial heat treat furnace, preferably of the batch type and will be described and explained with particular reference thereto. However, the invention has broader application and may be used for other industrial furnaces, such as coil annealing covers, or in any instance where a heated pressure vessel must be positively sealed to a relatively cold member.

INCORPORATION BY REFERENCE

The invention described herein relates generally to an industrial heat treat furnace described in my prior patent application entitled "HIGH TEMPERATURE CONVECTION FURNACE", Ser. No. 865,839 filed May 21, 1986 and which is incorporated herein by reference. The invention described herein also relates to my co-pending patent application entitled "CONVECTIVE HEAT TRANSFER WITHIN THE FURNACE CHAMBER OF AN INDUSTRIAL HEAT TREATING FURNACE" filed as of the date of this application, Ser. No. 129,012, which is also incorporated herein by reference and referred to hereafter as my "co-pending" application.

BACKGROUND OF THE INVENTION

In my prior patent applications, a unique, heat treating furnace is disclosed. The furnace uses a thin-walled, cylindrically shaped, longitudinally extending imperforate shell member disposed within a chamber or an enclosure formed in the insulated casing of a standard heat treat furnace. Heretofore, that chamber or enclosure was the heat treat chamber. By placing the work within the shell or interposing the shell member between the work and the furnace chamber a number of advantages are obtained over conventional heat treat furnaces. One of the principal benefits of such a furnace arrangement is that the shell can be pressurized and operated as a standard atmosphere furnace or a vacuum can be drawn within the shell and the furnace simply switched in operation to that of a vacuum furnace. The manufacturing cost of the furnace is about equal to or slightly in excess of the cost of a standard atmosphere furnace. The furnace casing is similar to and thus costs the same as or slightly less than that of the standard furnace while the cost of the shell member is believed to be slightly in excess of the radiant burner tubes now used in standard furnaces. The costs are believed less than that of a vacuum furnace since the furnace chamber need not be vacuum welded with a surrounding water jacket throughout.

My prior patent applications incorporated by reference disclosed heating and cooling arrangements for both the outside shell surface and the inside shell surface which individually and collectively materially enhance the heat treating processing times whether the furnace be used either as a standard atmosphere furnace or as a vacuum furnace. Another material advantage residing in the furnace disclosed is the fact that gas burners can be employed to directly fire their products of combustion into the furnace chamber to heat the exterior surface of the shell and that the use of gas burners for vacuum heat treating is thus possible.

In considering various factors influencing the design of such a furnace, it is obvious that the imperforate shell member must be rather thin if the shell is to effectively function as a heat transfer exchange mechanism. Also, the shell diameter becomes large if the shell member is to hold commercial batches of workpieces typically loaded or placed into baskets or trays with load weights in excess of 1,000 pounds and a typical load volume of 24×36×20 inches. Finally, the heat treat processes require high temperatures. The maximum temperature is typically above the austenitizing temperature of 1625° F. for annealing, normalizing and heating for hardening. Carburizing takes place at even higher temperatures and heat treating of tool steels at higher temperatures yet. The thermal expansion of the shell member at such temperatures is significant, typically expanding a 40 inch diameter shell to well over 41 inches and even distorting the cylindrical shape of the shell itself.

The furnace environment requires that the furnace casing and the loading door of the furnace be cooled or cool enough to touch. Conventional sealing arrangements, at least for the front face of the furnace, use water passages in the door and the frame of the furnace casing to establish two cold surfaces which are then sealed by a low temperature elastomer seal. If this approach is tried for the shell member in the furnace disclosed herein, the heat in shell wall will come into almost instantaneous contact with a cold, water cooled surface. The temperature will rapidly drop over a short distance causing a thermal shock which will rupture the shell. Other older conventional sealing arrangements such as a fiber seal or, conceptually, a sand seal are not adequate because of the inherent leakage present in such seal arrangements which prevent a vacuum from being drawn within the shell.

The furnace of the present invention and as noted in my prior application is not entirely dissimilar, from a conceptual standpoint, than that of coil annealing covers used for some time in the steel mill box annealing processes for annealing coiled strips of steel. However, the box annealing processes used removable stand covers and removable coil covers which are thick-walled massive objects slowly heated at relatively low temperatures in a time consuming process. Importantly, the covers are sealed at their base usually by a sand seal or a loose fiber seal which inherently leak and, in fact, require a positive pressure within the coil cover to prevent leakage of the outside atmosphere into the protective annealing atmosphere within the cover. Nevertheless, the positive pressure within the cover occasionally ruins the integrity of the seal. However, leakage from the cover to the stand is not necessarily fatal to the steel mill annealing process because the stand itself is sealed.

Also bearing some resemblance to the recent invention and within the heat treat furnace art are muffle furnaces where a thick walled pipe member is structurally anchored at both of its ends to the furnace casing, thus defining a space between the pipe member and furnace casing used to heat the pipe member and the work placed therein. While such furnaces are suitable for certain applications involving continuous furnaces or furnace zones used in continuous furnaces, they are not widely used as a single chamber batch type furnaces because of, among other things, the excessive processing times to heat and cool the work vis-a-vis the relatively thick walls of the muffle and the inability to use elastomer seals to efficiently seal the opening.

SUMMARY OF THE INVENTION

It is thus a principal object of the present invention to provide a non-destructive sealing arrangement for use with an imperforate shell member containing a workpiece which is subjected to a heat treat process by heat exchange from the shell member to the workpiece.

This object along with other features of the invention is achieved by means of a sealing arrangement in combination with a furnace where an imperforate, thin-walled, cylindrical shell member which receives workpieces to be heat treated therein has a flanged open end secured to the furnace casing at the front of the furnace. A door mechanism for opening and closing the flanged open end of the shell member is provided. An elastomer seal is provided between the door mechanism and the flanged open end for sealing the door and the flanged open end when the door mechanism is in the closed position. A heating arrangement is provided for directly heating the shell member at a spaced longitudinal distance from the flanged end to a heated temperature. An insulating arrangement extending over the spaced distance is provided for shielding the inner surface of the shell member and the outer surface of the shell member from heat flux emanating from the heating arrangement. A liquid cooling arrangement adjacent the flanged end is then provided for gradually cooling the wall of the shell member from the heated temperature to the cooled temperature at the flanged end over the spaced distance without rupturing the shell member.

In accordance with a somewhat broader aspect of the invention, a combination vacuum-standard atmosphere heat treat furnace is provided which comprises a furnace casing defining an enclosure having an opening, an open ended, thin-walled cylindrical shell member extending through the enclosure opening and for receiving workpieces to be heat treated therein. Means are provided to heat the shell member and door means are provided for opening and closing the opening in the shell member. Means are then provided to establish a temperature gradient in the wall of the shell member from a minimum temperature at the open end to a maximum temperature at a spaced distance from the open end to permit a sealing arrangement to be inserted between the open end of the shell member and the door means to seal the opening when the door mechanism closes the opening thus permitting the furnace to be commercially operated in a satisfactory manner either as a standard atmosphere furnace or as a vacuum furnace.

In accordance with another more specific feature of the invention, a relatively thick-walled annular flange is secured to the outside diameter of the shell member and a water jacket is provided at the juncture therebetween. Extending in an axial direction from the interior face surface of the door is a cylindrical shroud which is insulated. When the door is in a closed position, the shroud provides a blanket of insulation spaced closely adjacent the interior surface of the shell member and extending a spaced distance into the shell. Similarly, a blanket of insulation extending from the flanged end an axial distance equal to the spaced distance is in contact with the exterior surface of the cylindrical shell member. The shell member outside of the spaced distance is heated by convection and radiation from the heating means. The insulation adjacent the outer surface of the shell member minimizes any heating of the shell portion within the spaced distance by convection and radiation emanating from the heating means. Within the interior of the shell member the shroud member shields the inner surface of the shell member from heat flux originating within the shell member. The internal flux is attributed to radiation from the heated work and to convection from the atmosphere circulating within the furnace by a fan arrangement. The water jacket adjacent the flange on the shell member is then effective to act as a liquid cooling source to gradually decrease by conduction the heat within the wall portion of the shell member at the highest temperature at the spaced distance furthest removed from the flanged end to a temperature approximately equal to the water temperature adjacent the flanged end. By shielding the flanged end of the shell member both internally and externally from heat flux, to permit the water jacket to principally cool the shell member by conduction, a smaller spaced distance is needed than what is otherwise required. Thus, the shell member's length is optimized to a shorter length than that which might otherwise be required from the use of other insulation arrangements.

In accordance with another feature of the invention a door mechanism is provided which insures that it is first rotated into axial alignment with the shell opening and then axially moved into accurate alignment within the shell opening to maintain the proper dimensional relationship between the inner surface of the shell member and the insulation from the shroud. This is achieved by securing the door to an arm which in turn is secured to a carriage which moves in a longitudinal direction on a beam rail which extends above the furnace and is pivoted at a point adjacent the rear end of the furnace. A trolley positioned between the carriage and the pivot at a fixed position on the rail rides on a fixed track which is concentric with the pivot. Adjustments are provided on the carriage to permit the proper vertical adjustment of the shroud relative to the shell member and a stop on the track is provided to insure proper rotation of the door into alignment with the longitudinal center line of the shell member to achieve the straight line motion necessary to move the door the spaced distance required into the shell member to achieve desired contact with the elastomer seal. Thus, when the shell member expands over the spaced distance and assumes a frustoconical configuration, the space between the inner surface of the shell member and the shroud does not increase to the point where convective heat flux materially heats the inner surface of the shell member over the spaced distance.

It is thus another object of the invention to provide a sealing arrangement for an open ended, cylindrical shell membrane which can be inserted into the furnace chamber of a furnace constructed in accordance with normal fabrication techniques and function as a vacuum furnace or a standard atmosphere furnace for heat treating purposes.

It is another object of the invention to provide a sealing arrangement for an open ended imperforate cylindrical shell member which can be operated as a vacuum heat treat furnace with the shell heated by gas fired burners.

It is another object of the invention to provide a sealing arrangement for a shell membrane which isolates heating flux to permit the shell membrane to be cooled by conduction over a short discrete length thereof.

It is yet another object of the invention to provide a precisely aligned door closure assembly for a furnace which insures rotation of the door into proper alignment with the furnace opening followed by axial movement of the door into proper seal contact.

Still yet another object of the invention is to provide a simple and inexpensive arrangement for sealing a thermally expandable member subjected to elevated temperatures.

Yet a still further object of the invention is to provide a low temperature, elastomer seal for a member which undergoes significant thermal expansion at high temperatures.

BRIEF DESCRIPTION OF THE DRAWINGS

The invention may take physical form in certain parts and arrangement of parts, a preferred embodiment of which will be described in detail and illustrated in the accompanying drawings which form a part hereof wherein.

DETAILED DESCRIPTION OF THE PREFERRED EMBODIMENT

Figure 1:
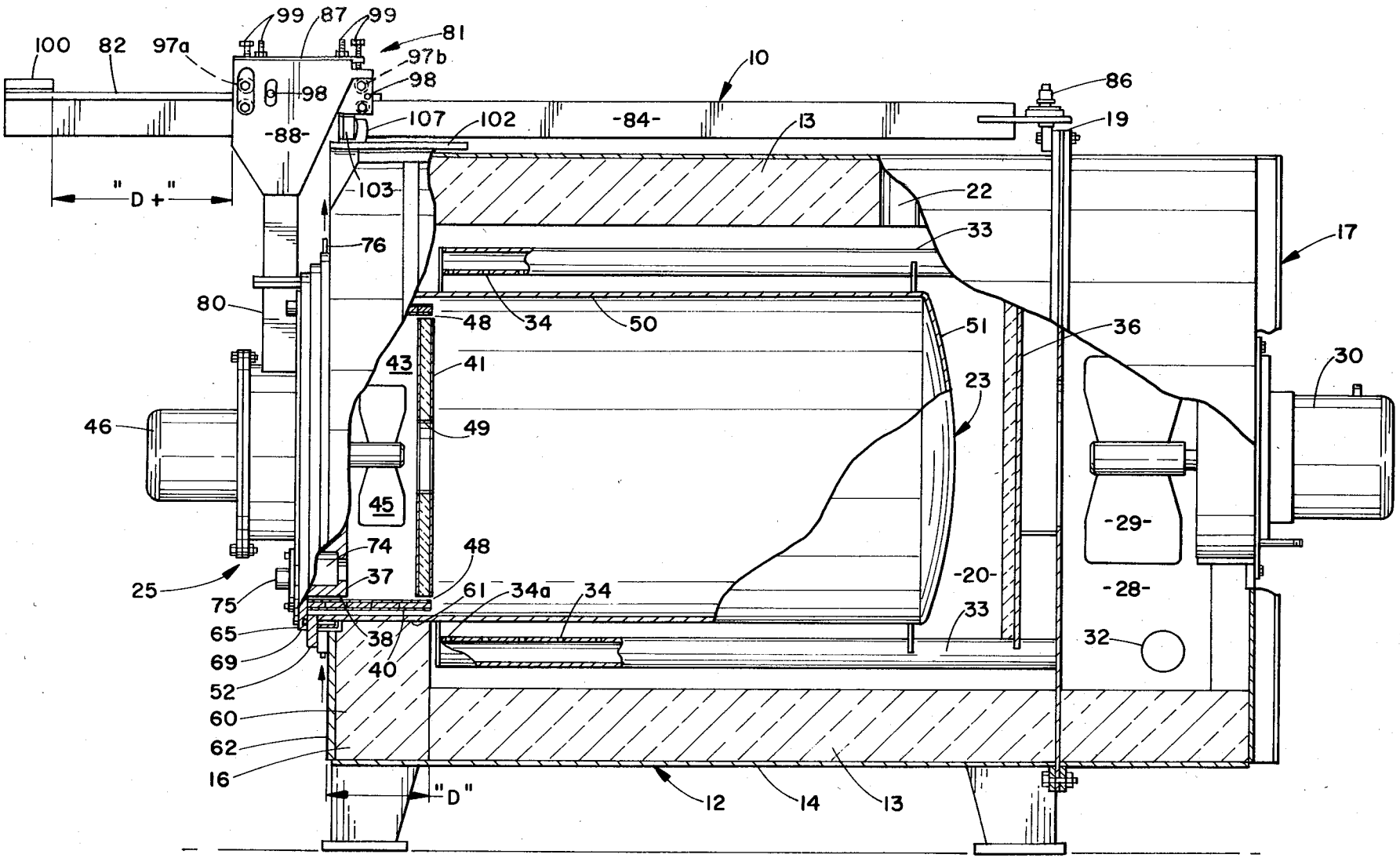
FIG. 1 is a side view of the furnace of the present invention with portions of the furnace broken away to illustrate particular interior details.
Figure 2:
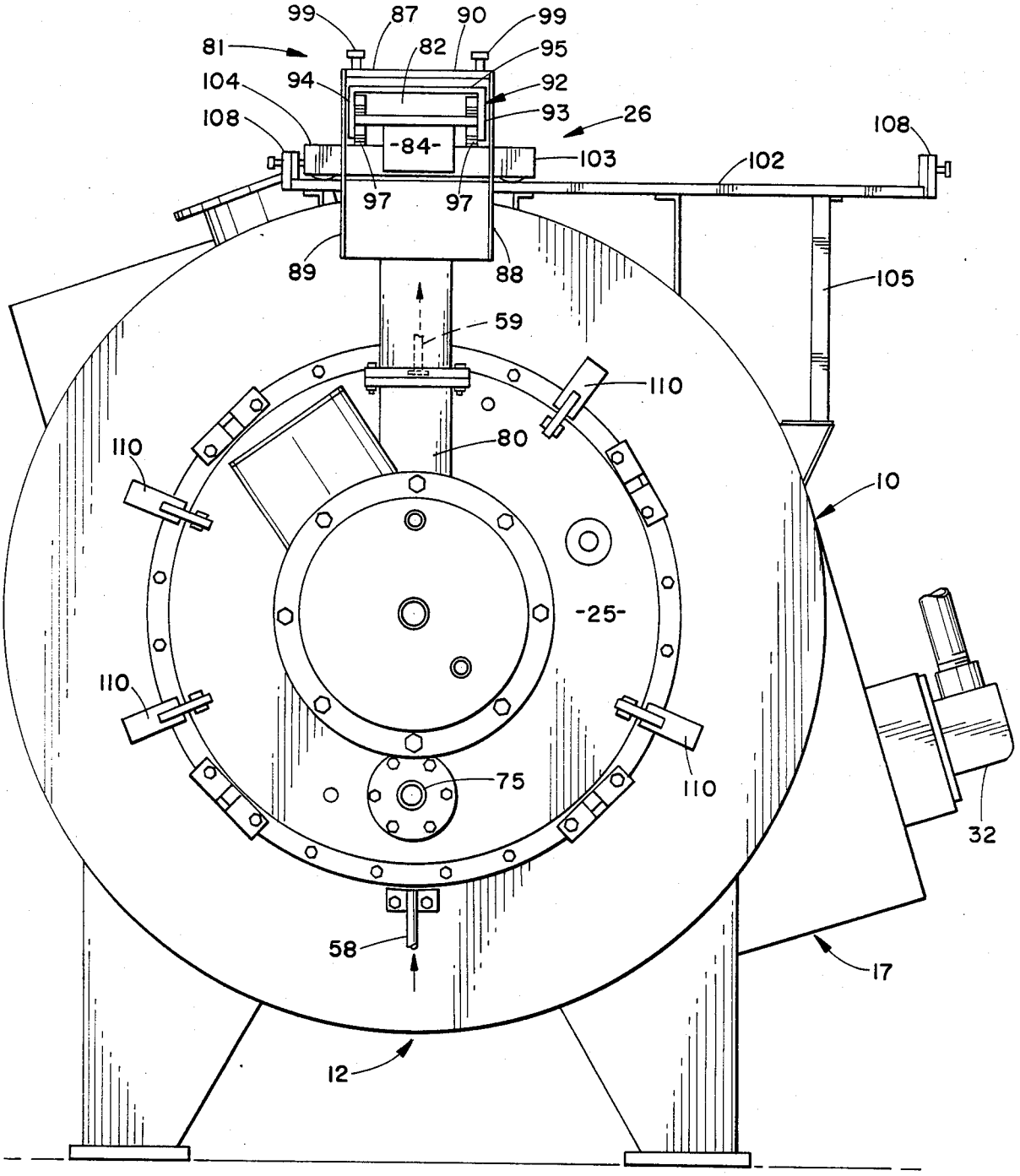
FIG. 2 is an end view of the furnace shown in FIG. 1.

Referring now to the drawings wherein the showings are for the purpose of illustrating a preferred embodiment of the invention only and not for the purpose of limiting the same, FIGS. 1 and 2 show a furnace 10 of the present invention. Furnace 10 in general comprises a central casing section 12 which can be of any tubular cross-sectional configuration but preferably is circular to define a cylindrical section. Central casing section 12 is constructed in the conventional manner. That is, conventional, refractory type fibrous insulating material 13 is impaled on rods (not shown) secured to an exterior casing cylindrical wall 14 and held in place by buttons or fasteners (not shown). At the interior of central casing section 12, sheet metal plates (not shown) can be provided to protect insulating material 13. Alternative constructions could include a water jacket construction or, in concept, a porous refractory composition. However, the fibrous insulation shown is preferred to minimize costs. In this way, a standard atmosphere type furnace is constructed which is suitable for use as a vacuum furnace.

At the forward end of central casing section 12 there is provided an insulated collar section 16 and the rearward end of central casing section 12 is closed by means of a rear block section 17. Rear block section 17 is secured to central casing section 12 by a bolted flange arrangement shown at 19. Central casing section 12, insulated collar section 16 and rear block section 17 define a furnace chamber 20 which has an opening 22 to the stack (not shown). A baffle (not shown) in the stack controls the overall pressure levels within furnace chamber 20. Extending within furnace chamber 22 is an imperforate, thin-walled cylindrically shaped imperforate shell member 23. A door 25 is provided for closing the imperforate shell member 23 and a door manipulator mechanism shown generally at 26 is provided for opening and closing door 25.

For purposes of describing the present invention, one of the functions of rear block section 17 is to supply heat to furnace chamber 20. In my prior application (U.S. Ser. No. 865,839 filed May 21, 1986) an arrangement for providing heat to furnace chamber 20 is disclosed and is likewise utilized and shown in FIG. 1 hereof. Reference may be had to my prior application for a more detailed explanation than that set forth in this specification. For purposes of explaining the operation of furnace 10 in this specification, an outside plenum chamber 28 is formed in rear block section 17 into which is disposed paddle blades 29 of a radial fan 30 which exhausts, under high pressure, the products of combustion from gas burners 32 (which are also in outside plenum chamber 28) through a plurality of longitudinally-extending distribution tubes 33. Distribution tubes 33 extend at equally spaced radial increments and equally spaced circumferential increments about imperforate shell member 23 and have a plurality of apertures or nozzles 34 formed at equally spaced increments about the length of tubes 33 and orientated to direct their jet streams of heated gas against imperforate shell member 23. An insulated baffle 36 secured to rear block section 17 serves to hold distribution tubes 33 in place while preventing direct impingement of the spherical rear end of shell member 23 from gases emanating from plenum chamber 28. Shell member 23 is thus heated convectively by the jet streams emanating from nozzles 34 and radiantly by the heat emanating from distribution tubes 33 which are, initially hotter than the wall of imperforate shell member 23. For the typical heat treating processes, especially those which occur at lower temperatures, such as tempering, the emphasis is on heat transfer by convection and the distribution tube 33 arrangement is distinctly preferred. The distribution tubes 33 provide an arrangement which produces an extremely uniform heat transfer about the entire area of shall member 23. However, the invention is not limited, in theory, to the mechanism used to heat the O.D. of shell member 23 illustrated herein. Alternative arrangements will suggest themselves to those skilled in the art.

In the preferred manner of operating the furnace of my present invention, an arrangement is provided for transferring the heat provided to imperforate shell member 23 from furnace chamber 20 to the work positioned within imperforate shell member 23 and such an arrangement is disclosed in my co-pending application, filed as of the date hereof, and entitled "CONVECTIVE HEAT TRANSFER WITHIN AN INDUSTRIAL HEAT TREATING FURNACE". Reference may be had to my co-pending application for a more thorough description of such an arrangement than that which will be provided in this specification. For purposes of the present specification door 25 has an inner face surface 37 and an outer edge cylindrical surface 38. Secured to outer edge cylindrical surface 38 is a cylindrical shroud member 40 to which a baffle plate 41 is secured. Door inner face surface 37, shroud member 40 and baffle plate 41 define an inner plenum chamber 43. Inside inner plenum chamber 43 are paddle blades 45 of an inner fan motor 46. An orifice 48 formed between baffle plate 41 and shroud 40 provides an annular outlet for gases within inner plenum chamber 43 to transfer heat from imperforate shell member 23 to the work while a central opening 49 in baffle plate 41 provides a return under pressure zone for the spent gases to be drawn back into inner plenum chamber 43. Thus, in the preferred embodiment, the interior surface of imperforate shell member 23 at some point in time is heated or more properly maintained at a temperature by the convectional internal heat transfer and also by radiation back from the work within imperforate shell member 23.

Figure 3:
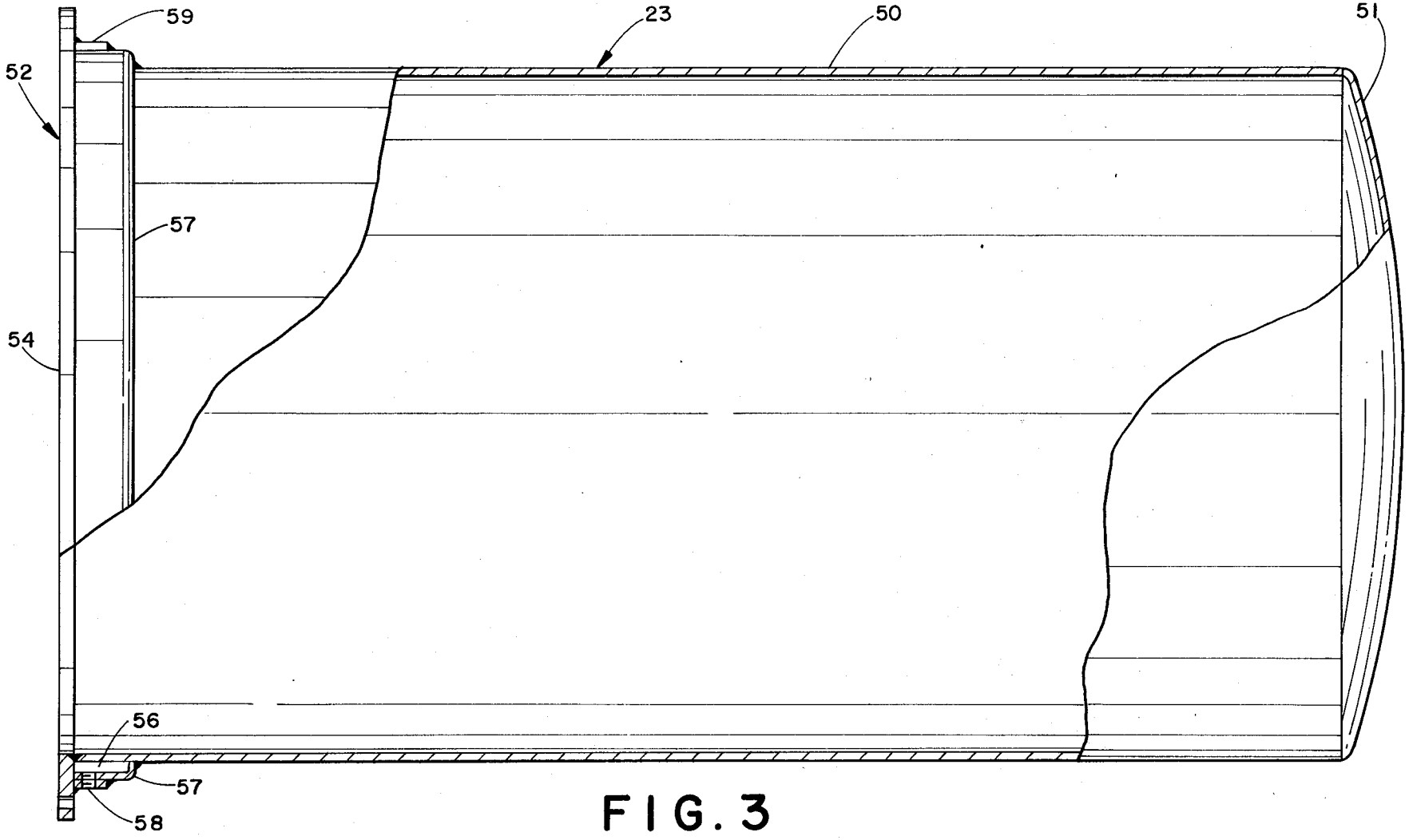
FIG. 3 is a side view of the shell member used in the furnace of the present invention.

Referring now to FIG. 3, cylindrical imperforate shell member 23 has a longitudinally extending cylindrical body section 50, a closed spherical end wall section 51 and an open ended, radially outwardly flanged section 52. Shell member 23 is preferably formed of a high alloy, stainless steel such as 304L. A cylindrical body section 50 of 0.25" has been found acceptable. It is believed that body sections having thickness between ⅛" and ½" will adequately function but preferred thicknesses will be in the range of 0.25" to 0.375". Cylindrical body section 50 is rolled to the proper diameter, typically 40 inches or so and then sealed along its entire longitudinal length (typically 2 to 8 feet) by vacuum tight, full penetration welds as are all the welds used in forming imperforate shell member 23. While shell members 23 of diameters as little as 10" have been designed, the preferred range of diameters for shell members 23 is from 24 to 92 inches. That is shell member 23 within this range can be accommodated by the inventive principles disclosed herein by simply dimensionally sealing the furnace up or down as the core may; be without additional supports, seals, etc., being included. Spherically shaped thin-walled section 51 is of the same thickness as cylindrical body section and is welded in a vacuum type manner thereto. Flange section 52 which is annular in configuration is likewise welded to cylindrical body section 50 but its thickness is typically about ¾ of an inch and its exterior face 54 is finish ground. Adjacent the juncture of flange 52 with body section 50 is a water passageway 56 formed by a ring shaped member 57 having a "L-shaped" cross-section configuration with one leg of the L welded to cylindrical body section 50 and another leg of the L welded to flange 52. A water inlet 58 and a diametrically opposed outlet 59 are provided in ring member 57. Not shown are distances pieces welded to flange section 52 adjacent water inlet 58 and 59 which are matched to provide support for coolant lines secured to inlet 58 and outlet 59.

Figure 1A:
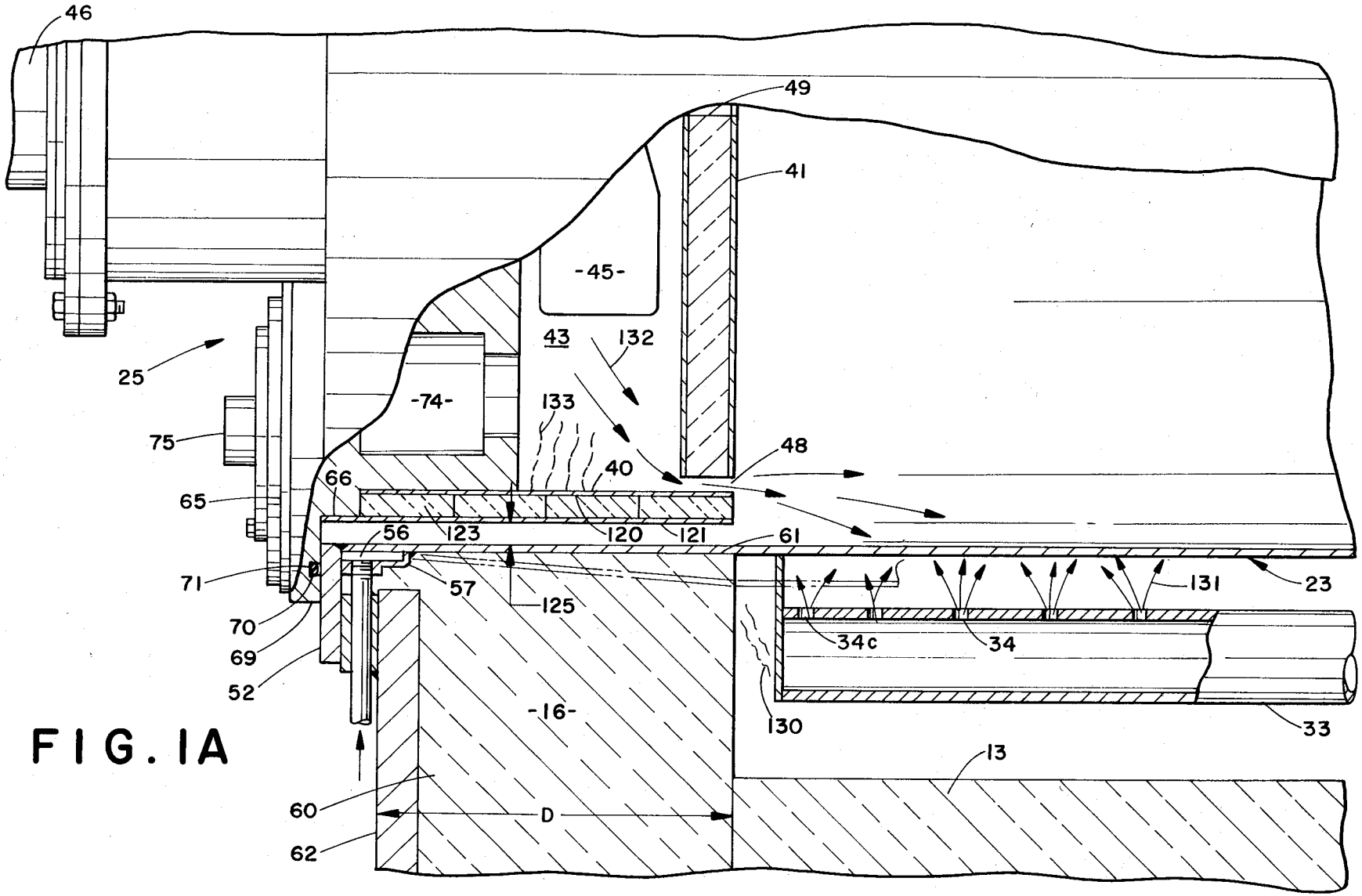
FIG. 1*a* is an enlarged view of a portion of the furnace shown in FIG. 1.

Referring now to FIGS. 1 and 1*a*, door 25 which houses inner radial fan 46 is shown for ease of explanation as a one-piece, solid block arrangement. In practice, door 25 will be fabricated and will be connected to a number of conventionally flexible joint connections i.e., for example, vacuum connections, gas lines, thermo couples, etc. and will have additional water passages in accordance with conventional practices other than those disclosed herein but which have no bearing or effect on the operation of the present invention.

As shown in FIGS. 1 and 1a, collar section 16 is an annular shaped mass of insulation 60 extending a longitudinal or axial distance designated as "D" and having a cylindrical opening nominally equal to the outside diameter of cylindrical imperforate shell member 23. The insulation 60 in collar section 16 can be the conventional fibrous material type as described for central casing 12 but without inner sheet metal sections. Alternatively there could be one or two inch strips of a ceramic blanket insulation having a weight of about six or eight pounds per square inch which could rest upon the conventional insulation extending about the inner diametrical cylindrical surface 61 of collar section 16. Collar section 16 has an exterior face surface defined by a relatively heavy annular plate 62 which is secured at its outer diameter to cylindrical wall 14 and is preferably bolted in an annular pattern to flange 52 of imperforate shell member 23, so that the exterior surface of imperforate shell member 23 rests on insulated material 60 of collar section 16 about the inner diameter of cylindrical surface 61 thereof but is not supported by insulation material 60. Preferably, it is contemplated that the major support holding imperforate shell member 23 within furnace 10 is flange section 52 bolted to annular plate 62 so that cylindrical body section 50 can freely expand and distort when heated.

Door 25 as noted has an inner face surface 37 which is adapted to extend into imperforate shell member 23 when door 25 is in the closed position and an external face surface 65 which is outside imperforate shell member 23 when door 25 is in a closed position. An edge surface 66 between outer face surface 65 and inner face surface 37 of door 25 includes, as noted, the cylindrical edge surface 38 adjacent inner face surface 37 and a radially outwardly extending annular flange surface 69 depending from cylindrical edge surface 38. An annular or keyway groove 70 is formed in annular flange section 69 and a conventional, annular elastomer seal 72 is disposed within annular groove 70 such that seal 72 is compressed when annular flange section 69 contacts shell flange section 52 when door 25 is in a closed position. An annular water jacket 74 with conventional inlets 75 and outlets 76 is provided within door 25 at an area adjacent seal 72 although not necessarily adjacent shroud member 40 for conventional purposes of cooling seal 72. Seal 72 is a conventional O-ring, about ⅜" diameter in cross-section, and is generally maintained at a temperature of about 100° F. vis-a-vis annular water jacket 74 and water passageway 56 and in any event, the temperature to which seal 72 is exposed to will ordinarily not exceed 150° F. As noted, the drawings do not show the flexible connections or the passageways within door 25 for injecting an inert or heat treating gas into imperforate shell member 23 nor the connection for a vacuum when furnace 10 is to be operated as a vessel nor are the thermo-couple or gas sampling instrument position shown or any sight glass that might be installed in door 25. All such connections are made to door 25 in a conventional manner.

Referring now to FIGS. 1 and 2, door manipulator 26 includes a rigid arm 80 secured at one end to cover 25 and at the other end to a carriage 81. Carriage 81 rides on a rail 82 fixed to a boom 84 which pivots in a horizontal plane about a trunnion 86 mounted to flange 19 of central casing section 12. Carriage 81 essentially comprises an inverted, U-shaped housing member 87 having side walls 88, 89 straddling rail 82 and connected by bight wall 90. Within U-shaped housing 87 is a second inverted U-shaped roller housing 92 also having right and left hand side walls 93, 94 connected by an adjustable bight wall 95. Each roller bearing side wall 93, 94 carries a pair of opposed rollers 97 adapted to contact the top and bottom surfaces of rail 82 therebetween and there is a forward and a rearward pair 97*a*, 97*b* of rollers for each roller bearing side wall 93, 94. Each pair of rollers are adjustable in a conventional manner to grip the rail therebetween (not shown) and provided with an associated eccentric 98 for maintaining U-shaped roller housing 92 centered laterally with respect to rail 82. Each roller pair 97 is also provided with a pair of adjusting screws 99 which secure carriage housing bight wall 90 to roller housing adjustable bight wall 95 (thus causing carriage 81 and roller housing 92 to move as one) and are adjustable in either a vertically upward or downward direction so that the door 25 can be precisely canted or cambered into proper alignment within imperforate shell member 23. Longitudinal travel of carriage 81 away from imperforate shell member 23 is limited by stop 100 and the distance of rail 82 is such so as to be not less than spaced distance "D" to insure that door 25 travels far enough away from imperforate shell member 23 to assure clearing of flange 52.

The weight of door 25 and boom 84 is supported by a track 102 which carries a trolley 103. Track 102 is fixed to cylindrical wall 14 of central casing section 12 in a level manner by appropriate structural supports 105. Trolley 103 simply comprises a plate 104 extending on both sides of boom 84 with a trolley roller 107 journaled at each end thereof to be in rolling contact with track 102. Trolley plate 104 is bent from its center a distance sufficient to insure that trolley rollers 107 fall on an arcuate path which is concentric with an arc struck from trunnion 86 and similarly track 102 is curved or has sufficient width to permit trolley rollers 107 to roll on such arcuate path until contacting trolley stops 108, one of trolley stops 108 serving as an axially aligned centering stop for door 25.

When door 25 is to be opened, carriage 81 is moved along rail 82 until shroud member 40 clears shell member's flanged end 52 and door 25 is then swung away from the opening in imperforate shell member 23 by trolley 103 rolling on track 102 until contacting the furthest removed trolley stop 108. The work is then removed from imperforate shell member 23 and new work placed therein and trolley 103 moved into contacting the center trolley stop 108 and door 25 moved into sealing contact with shell member's flanged end 52 by carriage 81 rolling on rail 82. If furnace 10 is to be operated at positive pressure, conventional latches 110 mounted on annular plate 62 of collar section 16 can engage flange section 69 of door 25 for maintaining compression of seal 72. In accordance with conventional practice, latches 110 are not needed to maintain integrity of seal 72 should furnace 10 be operated with a vacuum in imperforate shell member 23.

Referring again to FIG. 1*a*, shroud member 40 is insulated. Specifically, shroud member 40 comprises twelve gauge stainless steel inner and outer concentric sleeves 120, 121 spaced about 1" apart and filled with a ceramic blanket insulation 123 which is cut into thin pieces and packed between inner and outer cylindrical sleeves 120, 121 at a density of about 8 pounds per square inch. The radial distance between outer sleeve 121 and the inner surface of imperforate shell member 23 designated as at 125 is kept to a minimum clearance which can be carefully controlled by the precise centering adjustments described above for door manipulator 26. Radial distance 125 is typically controlled to $\frac{3}{8}$ inches or less. As noted in my co-pending application, radial distance 125 provides an under pressure zone which is necessary for the expansion of the internal jet. Given the area circumscribed by radial distance 125, the limiting factor is the door clearance in that an under pressure zone circumscribed by an annulus having a radial distance of 1/16" or even less will suffice to establish a sufficient under pressure zone for the jet expansion.

OPERATION

When imperforate shell member 23 is heated by distributor tubes 33, the diameter of imperforate shell member 23 will expand and, as noted above, the thermal expansion of the shell will be more than 1" at the temperatures of heat treating processes which can typically reach 1750°-1950° and at times, with high capacity burners, in excess of 2000° F. during heat up. Heat from distributor tubes 33 is transmitted to imperforate shell member 23 by a heat flux which comprises transmission by radiation 130 from tubes 33 and transmission by convection 131 from the jet streams emanating from apertures 34 which impinge the outer surface of imperforate shell member 23. As this occurs, insulation 60 in collar section 16 prevents the transmission of convective heating flux and the transmission of radiation flux to the exterior surface of imperforate shell member 23 over the spaced distance "D". Turning now to the inside of imperforate shell member 23 and as more fully described in my co-pending application, as imperforate shell member 23 becomes hot, the atmosphere within imperforate shell member 23 is likewise increased in temperature. However, the heated atmosphere can not heat by convective flux 132 the inner surface of imperforate shell member 23 over spaced distance "D" because of the presence of insulation 123 in annular shroud member 40. Also, shroud member 40 can not act as a source of radiation 133 to the inner surface of imperforate shell member 23 over spaced distance "D". As noted in my prior application, radial distance 125 is an under pressure or a dead zone and the atmosphere entrained within the jet leaving orifice 48 does not enter this zone. Thus the jet formed at orifice 48 does not heat the inner surface of imperforate shell member 23 over spaced distance "D". The only heat flux which heats imperforate shell member 23 over spaced distance "D" is that which is carried by conduction. The conduction flux can be gradually decreased by water passageway 56 which acts as a heat sink in accordance with known heat transfer formula to gradually draw down, in a theoretically linear fashion, the temperature from a maximum which exists at the innermost end of collar section 16 adjacent furnace chamber 20 to the temperature of the water within water passageway 56 (typically about 100° F.). Without the insulation placed in the manner described, heat flux either by radiation or convection could otherwise impinge that portion of shell member 23 within spaced distance "D" to adversely inhibit the conduction cooling effect from water passageway 56. The convective and radiation flux would actually nullify the conduction cooling over spaced distance "D" with the result that a huge temperature drop would occur at the point of water passageway 56 which would shock or rupture imperforate shell member 23. In connection with this discussion, it should be noted that the insulation 123 in shroud member 40 is critical to the efficient functioning of the invention whether or not the atmosphere within imperforate shell member 23 is circulated by inner fan motor 46 or not. That is, if the work inside imperforate shell member 23 were heated simply by radiation from imperforate shell member 23 that heat, in turn, would be radiated back to the inner surface of imperforate shell member 23 over spaced distance "D" and this, in turn, would adversely affect the gradual cooling by conduction attributed to water passageway 56 with the result that the spaced distance "D" would have to be significantly larger to compensate for the radiation heat flux.

The problem becomes especially significant when considering the jet stream produced by inner fan 46. That is, when the imperforate shell member 23 undergoes thermal expansion, the gradual cooling attributed to the arrangement disclosed in the present invention causes imperforate shell member 23 to assume a frusto-conical shape over spaced distance "D" crushing insulation 60 in collar section 16. When this occurs, radial distance 125 increases and should this distance materially increase the annular space between shroud member 40 and the inner diametrical surface of imperforate shell member 23 will increase to the point where an under pressure zone will not exist. This will cause eddy current from the internal jet within orifice 48 to flow into such increased space and heat the inner surface of imperforate shell member 23 over a portion of spaced distance "D" which in turn will cause a severe temperature shock leading to rupture of imperforate shell member 23. Thus, spaced distance "D" must be long enough to maintain a sufficient close distance for an under pressure zone to permit an adequate temperature gradient by conduction cooling. This is made possible by door manipulator 26. In practice and for the dimensions discussed, a spaced distance "D" of approximately 12" has proven acceptable.

It should also be noted that water passageway 56 in the imperforate shell member 23 will also function, in a limited manner, as a heat sink for insulation 60 in collar section 16 and will enhance cooling of imperforate shell member 23 over spaced distance "D". To a lesser extent, water jacket 74 provides some heat conduction for insulation 123 in shroud member 40. Theoretically then insulation 60, 123 can, to some extent, cool imperforate shell member 23 but in practice, the cooling effected by insulation 60, 123 is insignificant when compared to their function as a barrier to prevent the transmission of heat flux from the entrained heat source to imperforate shell member 23.

It must also be noted that the invention has been described with reference to a furnace 10 where the work within shell member 23 is heated and cooled both internally and externally of the shell. There are many applications of furnace 10 where the work within shell member 23 need not be cooled by internal radial fan 46 and the work is singly heated and cooled by a source outside shell member 23. In such instances, the design disclosed herein can be materially simplified by eliminating shroud member 40, as a part of door 25. Instead, an insulating collar could be attached to flange 52 and extend inwardly the design distance "D" to prevent any adverse effects of re-radiation and the door design simplified accordingly.

The invention has been described with reference to a preferred embodiment. It is apparent that many modifications may be incorporated into the furnace disclosed without departing from the spirit or essence of the sealing mechanism disclosed. For example, the sealing arrangement has been disclosed with reference to a heat treat furnace. However, the arrangement disclosed can very well be suitable for use as a sealing arrangement for coil annealing covers thus permitting the faster processing times inherently present in the furnace of the design disclosed. Further, the invention has been disclosed with reference to its use as a door for a single chamber batch type furnace and it should be apparent that appropriate modification may be made to permit its use in a multi-chamber furnace application since the spherical end of imperforate shell member 23 could be replaced by a similar seal arrangement for a furnace chamber leading for example to a quench chamber. It is my intention to include all such modifications and alterations insofar as they come within the scope of the present invention.

It is thus the essence of my invention to provide a means for controlling the thermal expansion of a thin-walled member so that a cold surface can be maintained at some defined point thereon for use as a sealing surface against a mating cold surface or for some other suitable application.

Having thus defined my invention, I claim:

1. A sealing arrangement in combination with an industrial heat treat furnace comprising:

an imperforate, thin walled, metal cylindrical shell member for receiving workpieces to be heat treated therein, said shell member having a cylindrical body portion terminating at a flanged open end;

door means for opening and closing said flanged open end;

an elastomer seal between said door means and said flanged open end for sealing said door and said flanged end when said door is in a closed position;

heating means within said furnace for heating said work and said body portion of said shell member to a high furnace temperature;

liquid cooling means adjacent said seal for keeping said seal at a cool, non-destructive temperature;

insulating means extending from said flange end along said body portion a spaced distance for substantially shielding said inner surface of said shell member and said outer surface of said shell member over said spaced distance from heat flux emanating from said heating means; and said liquid cooling means in combination with said insulating means gradually cooling said shell member from said furnace temperature to said cool non-destructive temperature at said flanged end over said spaced distance to establish a temperature gradient therebetween which prevents rupturing of said shell member.

2. The sealing arrangement-furnace combination of claim 1 wherein said spaced distance is approximately 12 inches for a cylindrical shell member of approximately 40 inches in diameter.

3. The sealing arrangement-furnace combination of claim 1 wherein that portion of said shell member within said spaced distance assumes a frusto-conical shape when heated to a heat treating temperature.

4. The sealing arrangement-furnace combination of claim 3 wherein said heating means includes means to heat by radiation and convection the exterior surface of said shell member.

5. The sealing arrangement-furnace combination of claim 4 wherein said heating means further includes means to additionally heat by radiation the interior surface of said shell member.

6. The sealing-furnace combination of claim 1 further including a furnace casing having a closed end and an open end defining a chamber therein, said open end having an exterior surface and an interior surface and a cylindrical collar between said interior and exterior surfaces for receiving said shell member, said collar extending a longitudinal distance substantially equal to said spaced distance, and furnace insulation placed in contact with said collar for shielding the exterior surface of said shell member over said spaced distance from heat flux attributed to said heating means.

7. The sealing arrangement-furnace combination of claim 6 further including said liquid cooling means in contact with said furnace insulation at said exterior surface of said furnace casing to enhance gradual cooling of the exterior surface of said shell member from said heated to said cool temperature.

8. A sealing arrangement in combination with a furnace comprising:

an imperforate, thin walled, cylindrical shell member for receiving workpieces to be heat treated therein, said shell member having a flanged open end;

door means for opening and closing said flanged open end;

an elastomer seal between said door means and said flanged open end for sealing said door and said flanged end when said door is in a closed position;

heating means for heating said shell member at a spaced distance from said flanged end to a heated temperature;

insulating means extending over said spaced distance for shielding said inner surface of said shell member and said outer surface of said shell member over said spaced distance from heat flux emanating from said heating means; and liquid cooling means adjacent said flanged end for gradually cooling said shell member from said heated temperature to a cooled temperature at said flanged end over said spaced distance without rupturing said shell member;

a furnace casing having a closed end and an open end defining a chamber therein, said open end having an exterior surface and an interior surface and a cylindrical collar between said interior and exterior surfaces for receiving said shell member, said collar extending a longitudinal distance substantially equal to said spaced distance, and furnace insulation placed in contact with said collar for shielding the exterior surface of said shell member over said spaced distance from heat flux attributed to said heating means;

said liquid cooling means in contact with said furnace insulation at said exterior surface of said furnace casing to enhance gradual cooling of the exterior surface of said shell member from said heated to said cool temperature; and said heating means heat said shell member by convection and radiation and said insulating means is effective to minimize heating the portion of said shell member within said spaced distance by convection and radiation from said heat means, said liquid cooling means effective to gradually decrease by conduction the heat within the wall of said shell member from said heated temperature at that point of said spaced distance furthest removed from said flanged end of said shell member to a point on said shell member adjacent said flanged end.

9. The sealing arrangement-furnace combination of claim 8 wherein said heating means includes means to heat by radiation and convection the exterior surface of said shell member.

10. The sealing arrangement-furnace combination of claim 9 wherein said heating means further includes means to additionally heat by radiation the interior surface of said shell member.

11. The sealing arrangement-furnace combination of claim 10 further including said door means including a door having an interior surface and an exterior surface, said interior surface having an insulated cylindrical shroud member extending therefrom a distance substantially equal to said spaced distance for insulating said interior surface of said shell member, said insulating means including said shroud member, the diameter of said shroud member being slightly less than the internal diameter of said shell member to define a radial distance therebetween.

12. The sealing arrangement-furnace combination of claim 11 wherein said heating means further includes means to additionally transfer heat to the interior surface of said shell member by a jet stream emanating at a point on said spaced distance furthest removed from said flanged end, said radial distance being small enough to create an under pressure zone preventing said jet from heating by convection the interior surface of the shell member over said spaced distance.

13. The sealing arrangement-furnace combination of claim 12 wherein said heat means heat said shell member by convection and radiation and said insulating means is effective to minimize heating the portion of said shell member within said spaced distance by convection and radiation from said heat means, said liquid cooling means effective to gradually decrease by conduction the heat within the wall of said shell member from said heated temperature at that point of said spaced distance furthest removed from said flanged end of said shell member to a point on said shell member adjacent said flanged end.

14. The sealing arrangement-furnace combination of claim 13 wherein said radial distance when said shell member assumes said frusto-conical shape over said spaced distance remaining small enough over a substantial portion of said spaced distance to prevent said jet from significantly heating by convection the interior surface of said shell member over a substantial portion of said spaced distance.

15. The sealing arrangement-furnace combination of claim 11 further including said door means operative to sequentially rotate said door into proper axial alignment with said flanged open end of said shell member and axially movable longitudinally into sealing engagement with said flange end of said shell member.

16. The sealing arrangement-furnace combination of claim 15 further including said door means adjustable to insure proper alignment of said shroud member within said shell member.

17. The sealing arrangement-furnace combination of claim 16 wherein said door means further includes an arm secured to said door at one end, a movable carriage said secured thereto at its opposite end;

a longitudinally extending rail, said carriage secured thereto and movable therealong;

a pivot at one end of said rail;

a fixed circular track concentric with said pivot, a trolley movable along said path and fixedly positioned on said track in between said carriage and said pivot, said trolley and said track supporting the weight of said door;

said rail extending a distance at least equal to said spaced distance beyond said carriage when said door is closed to permit said carriage to move said door longitudinally away from said flanged end of said shell member to avoid contacting said shroud member when opening said door.

18. The sealing arrangement-furnace combination of claim 17 further including a positive stop on said track for said trolley permitting said carriage to be moved along an axis parallel with the longitudinal axis of said shell member.

19. The sealing arrangement-furnace combination of claim 18 further including adjustment means on said carriage for insuring parallel, concentric alignment between said shroud member and the inner diameter of said shell member.

20. A sealing arrangement for an industrial heat treat furnace comprising:

(a) an insulated furnace casing having (i) a sidewall of tubular cross-sectional configuration, (ii) a closed end and (iii) an open end defining a chamber therebetween, said open end of said casing having an inwardly extending, insulated collar section, said collar section having a cylindrical inner surface defining the opening of said chamber and an outwardly extending face surface depending from one end of said cylindrical surface and an outwardly extending inner surface depending from the other axial end of said cylindrical surface;

(b) an imperforate, thin-walled cylindrical shell member having a closed end and an open end for receiving work to be heat treated therein, a radially outwardly extending flange formed at said open end of said shell member;

(c) said flange secured to said face surface with said shell member in contact with said cylindrical inner surface;

(d) a door for closing said open end of said shell member and said furnace casing, said door having an inner wall surface with a generally circular peripheral edge surface having a diameter less than that of said cylindrical surface of said collar section, and an outwardly extending sealing surface for contacting said flange of said shell member when said door is closed;

(e) insulated cylindrical shroud means spaced slightly radially inwardly of said collar section and extending an axial distance equal to said collar section for insulating the inside surface of said shell member;

(f) an elastomer seal between said sealing surface and said shell's flange;

(g) means for heating said shell member;

(h) door liquid cooling means for liquid cooling said inner wall surface of said door, shell liquid cooling means for liquid cooling said flange of said shell; and (i) door operating means for moving said door into sealing engagement with said elastomer seal whereby said insulated shroud and said insulated collar section establish a temperature gradient in that portion of said shell member contained therebetween sufficient to maintain said elastomer seal at a non-destructive temperature.

21. The sealing arrangement of claim 20 wherein said shroud means includes an insulated cylindrical shroud member secured to said peripheral edge surface, said shroud member having an outside diameter slightly less than the diameter of said cylindrical surface of said collar section and extending an axial distance approximately equal thereto.

* * * * *